US011857096B1

(12) United States Patent
Chen

(10) Patent No.: US 11,857,096 B1
(45) Date of Patent: Jan. 2, 2024

(54) TRACTION PILLOW

(71) Applicant: ZAMATSLEEP INC., Portland, OR (US)

(72) Inventor: Xin Chen, Portland, OR (US)

( * ) Notice: Subject to any disclaimer, the term of this patent is extended or adjusted under 35 U.S.C. 154(b) by 0 days.

(21) Appl. No.: 18/316,440

(22) Filed: May 12, 2023

(30) Foreign Application Priority Data

Apr. 18, 2023 (CN) ..... 202320874994.4

(51) Int. Cl.
*A47G 9/10* (2006.01)

(52) U.S. Cl.
CPC .... *A47G 9/1081* (2013.01); *A47G 2009/1018* (2013.01)

(58) Field of Classification Search
CPC .... A47G 9/1081; A47G 9/0253; A47G 9/109; A47G 9/1045; A47G 2009/1018; A47G 9/10
See application file for complete search history.

(56) References Cited

U.S. PATENT DOCUMENTS 3,883,906 A * 5/1975 Sumpter ..... A47G 9/1063 5/636
5,363,524 A * 11/1994 Lang ..... A47G 9/1081 5/951
6,041,458 A * 3/2000 Vickers ..... A47G 9/10 5/636
2016/0345760 A1* 12/2016 Pesale ..... A47G 9/109
2019/0090668 A1* 3/2019 Hafeznezami ..... A47G 9/1081

FOREIGN PATENT DOCUMENTS

GB 2589534 A * 6/2021 ..... A47G 9/0253
KR 20100000363 A * 6/2010 ..... A47G 9/1081

* cited by examiner

*Primary Examiner* — Justin C Mikowski
*Assistant Examiner* — Alison N Labarge

(57) ABSTRACT

A traction pillow includes a pillowcase and an elastic pillow interior. The pillow interior has an opening, and the opening penetrates from an upper side of the pillow interior to a lower side of the pillow interior. The pillowcase includes an upper surface and a lower surface. The upper surface is provided with a first connector. The lower surface is provided with a second connector, and when the pillowcase sleeves the pillow interior. The first connector is detachably connected to the second connector via the opening to enable the upper surface and the lower surface to clamp the pillow interior, and the upper surface and the lower surface press the pillow interior to form a neck brace supporting portion.

18 Claims, 5 Drawing Sheets

TRACTION PILLOW

CROSS-REFERENCE TO RELATED APPLICATIONS

The application claims priority of Chinese patent application CN202320874994.4, filed on Apr. 18, 2023, which is incorporated herein by reference in its entireties.

TECHNICAL FIELD

The present disclosure relates to the field of pillows, in particular to a traction pillow.

BACKGROUND

It is good for users to sleep using traction pillows. A traction pillows can mainly reduce a force on the cervical vertebra, reduce the possibility of a stiff neck, help relax the muscles around the neck, improve the blood circulation, and alleviate symptoms of neck pain and numbness. At the same time, the traction pillow can also slowly restore the physiological curvature of the cervical vertebra of a cervical spondylosis patient. However, there are traction pillows on the market at present. When a user uses a traction pillow, if the traction pillow has an insufficient supporting force, the traction pillow is prone to collapse and unable to play a role of supporting the neck. As a result, the traction pillow cannot achieve effects of relaxing the muscles around the neck, improving the blood circulation, and alleviating the neck pain and numbness. Therefore, there is an urgent need to provide a traction pillow having a high supporting force and less prone to collapse on the market, to improve the user experience.

SUMMARY

In order to overcome the shortcomings in the prior art, the present disclosure provides a traction pillow which has a high supporting force and is not prone to collapse, so that muscles around the neck can be effectively relaxed, the blood circulation can be improved, the symptoms of neck pain and numbness can be relieved, and the user experience can be improved.

The present disclosure provides a traction pillow including a pillowcase and an elastic pillow interior, wherein the pillow interior has an opening; the opening penetrates from an upper side of the pillow interior to a lower side of the pillow interior; the pillowcase includes an upper surface and a lower surface; the upper surface is provided with a first connector; the lower surface is provided with a second connector; and when the pillowcase sleeves the pillow interior, and the first connector is detachably connected to the second connector via the opening to enable the upper surface and the lower surface to clamp the pillow interior, the upper surface and the lower surface press the pillow interior to form a neck brace supporting portion.

Further, the first connector is arranged on an inner side of the upper surface, and the second connector is arranged on an inner side of the lower surface.

Further, the first connector includes a first connection portion and a first connection surface; one side of the first connection surface is connected to the inner side of the upper surface; the first connection portion is connected to the other side of the first connection surface; the second connector includes a second connection portion and a second connection surface; one side of the second connection surface is connected to the inner side of the lower surface; the second connection portion is connected to the other side of the second connection surface; and the first connection portion is detachably connected with the second connection portion.

Further, when the first connector is connected to the second connector via the openingto enable the upper surface and the lower surface to clamp the pillow interior, a first gap is reserved between the upper surface and the opening; a second gap is reserved between the lower surface and the opening; and the first gap, the opening, and the second gap are communicated with each other to form a heat dissipation channel.

Further, the opening is formed in the middle of the pillow interior; when the first connector is connected to the second connector via the opening to enable the upper surface and the lower surface to clamp the pillow interior, the upper surface and the lower surface press the pillow interior to form the neck brace supporting portion located in the middle and side wing portions located on two sides.

Further, the upper surface and the lower surface press the pillow interior to form a recessed neck brace supporting portion located in the middle and raised side wing portions located on the two sides.

Further, the traction pillow further includes platforms located on two sides of the pillow, and the platforms are located below the side wing portions.

Further, the side wing portions are used for supporting the head, and the platforms are used for supporting arms.

Further, the pillow interior is a memory foam pillow interior or a latex pillow interior.

Further, the pillowcase has a sleeving hole; the pillowcase sleeves the pillow interior via the sleeving hole; a zipper is arranged at the sleeving hole; and the zipper is used for opening or closing the sleeving hole.

The present disclosure provides a traction pillow including a pillowcase and an elastic pillow interior, wherein the pillow interior has an opening; the opening penetrates from an upper side of the pillow interior to a lower side of the pillow interior; the pillowcase includes an upper surface and a lower surface; the upper surface is provided with a first connector; the lower surface is provided with a second connector; and when the pillowcase sleeves the pillow interior, and the first connector is detachably connected to the second connector via the opening to enable the upper surface and the lower surface to clamp the pillow interior, the upper surface has a concave portion to serve as a neck brace supporting portion.

Further, the first connector is arranged on an inner side of the upper surface, and the second connector is arranged on an inner side of the lower surface.

Further, the first connector includes a first connection portion and a first connection surface; one side of the first connection surface is connected to the inner side of the upper surface; the first connection portion is connected to the other side of the first connection surface; the second connector includes a second connection portion and a second connection surface; one side of the second connection surface is connected to the inner side of the lower surface; the second connection portion is connected to the other side of the second connection surface; and the first connection portion is detachably connected with the second connection portion.

Further, when the first connector is connected to the second connector via the openingto enable the upper surface and the lower surface to clamp the pillow interior, a first gap is reserved between the upper surface and the opening; a second gap is reserved between the lower surface and the opening; and the first gap, the opening, and the second gap are communicated with each other to form a heat dissipation channel.

Further, the opening is formed in the middle of the pillow interior; when the first connector is connected to the second connector via the opening to enable the upper surface and the lower surface to clamp the pillow interior, the upper surface and the lower surface press the pillow interior to form the neck brace supporting portion located in the middle and side wing portions located on two sides.

Further, the upper surface and the lower surface press the pillow interior to form a recessed neck brace supporting portion located in the middle and raised side wing portions located on the two sides.

Further, the traction pillow further includes platforms located on two sides of the pillow, and the platforms are located below the side wing portions.

Further, the side wing portions are used for supporting the head, and the platforms are used for supporting arms.

Further, the pillow interior is a memory foam pillow interior or a latex pillow interior.

Further, the pillowcase has a sleeving hole; the pillowcase sleeves the pillow interior via the sleeving hole; a zipper is arranged at the sleeving hole; and the zipper is used for opening or closing the sleeving hole.

Compared with the neck brace supporting portion directly formed in an existing ordinary pillow on the market, the neck brace supporting portion formed by pressing the pillow interior by the upper surface and the lower surface of the pillowcase is more full and has stronger cervical traction feeling, so that the traction pillow can provide a higher elastic reset supporting force, is not prone to collapse, and can provide a strong support to the neck, relax the muscles around the neck, improve the blood circulation, relieve the symptoms of neck pain and numbness, and improve the user experience.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
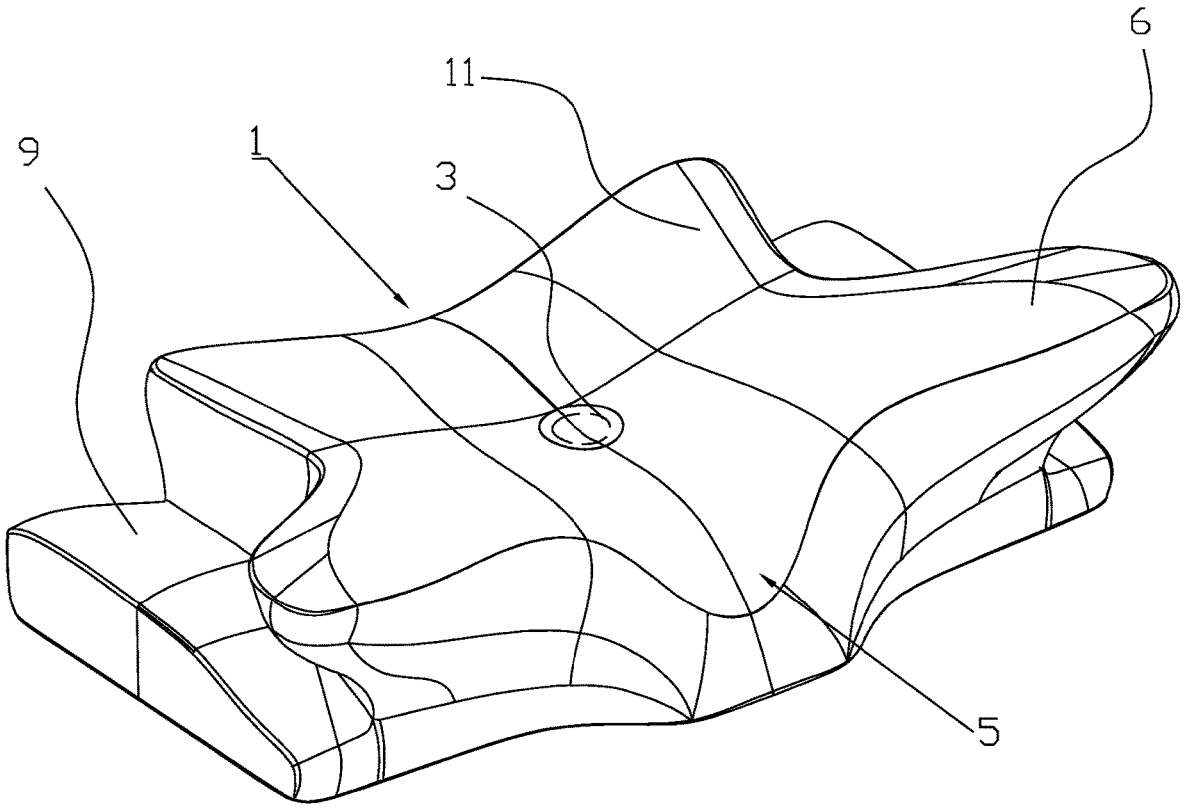
FIG. 1 is a schematic diagram of an overall structure of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

Figure 2:
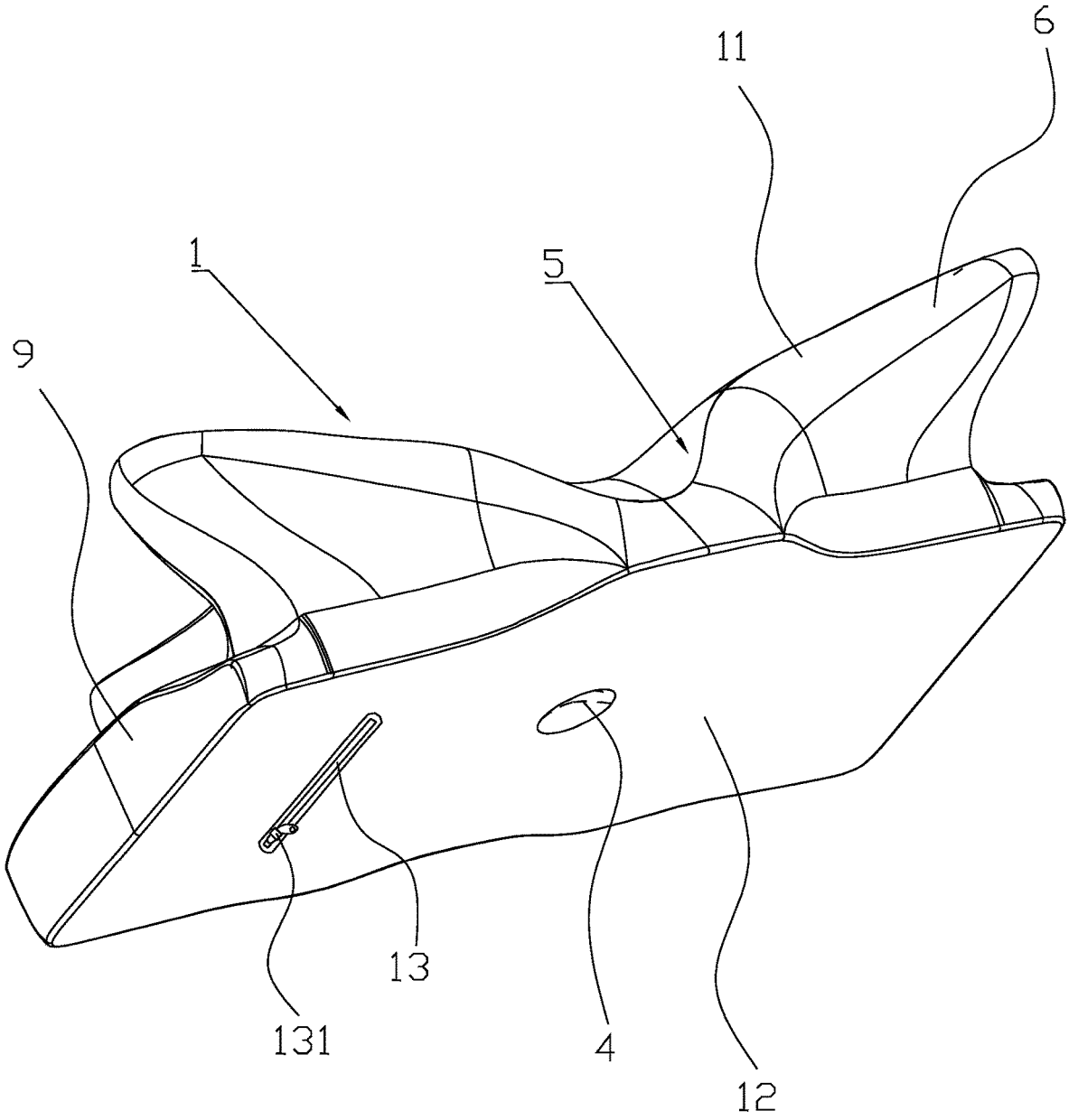
FIG. 2 is a schematic diagram of another overall structure of the present disclosure.
Figure 3:
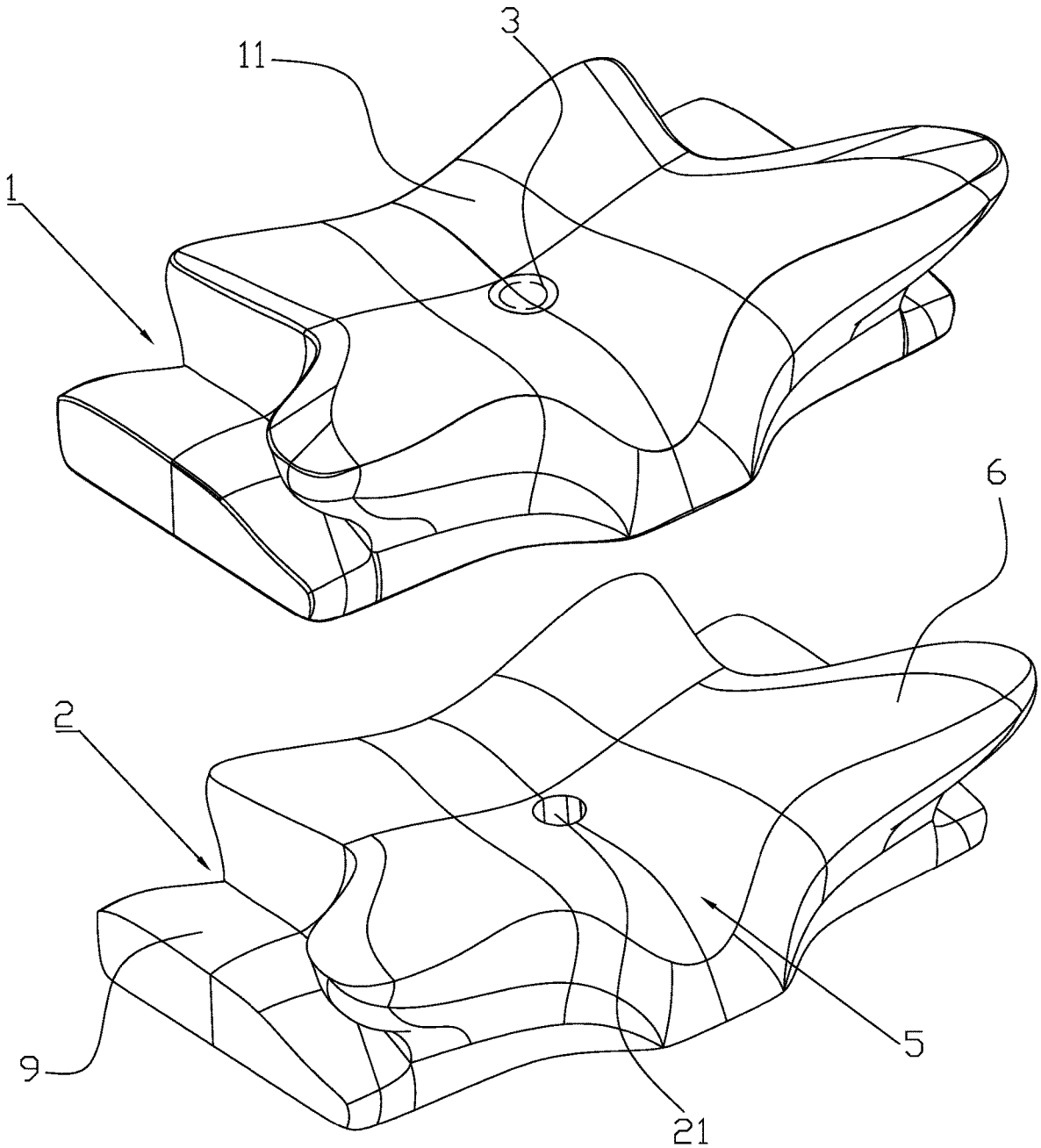
FIG. 3 is an exploded diagram of the present disclosure.
Figure 4:
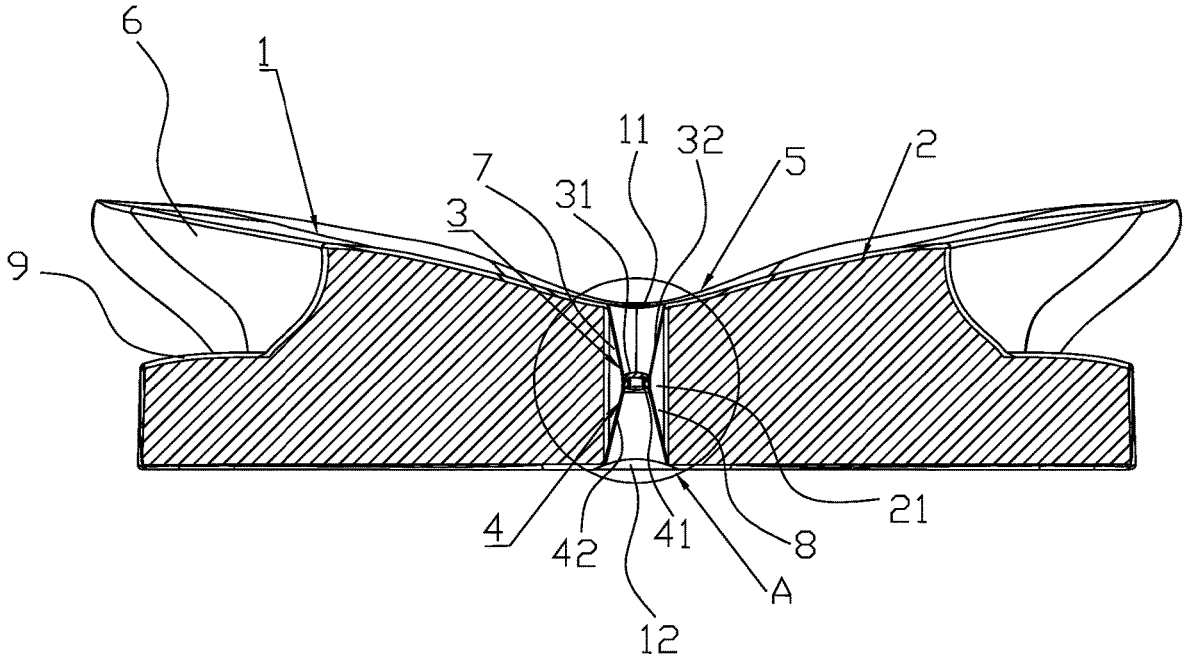
FIG. 4 is a sectional view of sectioning along an opening, a first connector, and a second connector.
Figure 5:
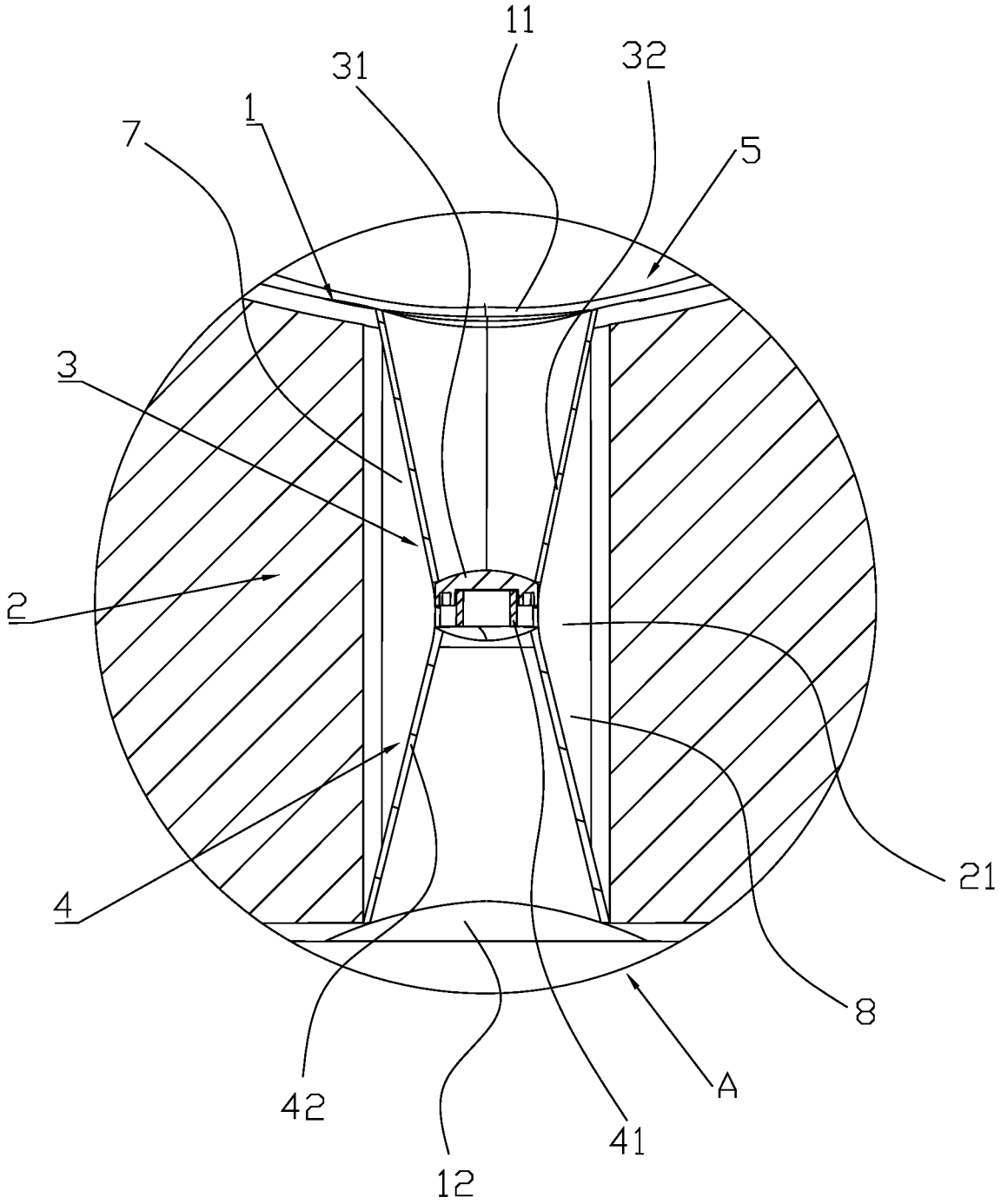
FIG. 5 is an enlarged diagram of the part A of FIG. 4.

Referring to FIG. 1 to FIG. 5, a traction pillow includes a pillowcase 1 and an elastic pillow interior 2. The pillow interior 2 has an opening 21. The opening 21 penetrates from an upper side of the pillow interior 2 to a lower side of the pillow interior 2. The pillowcase 1 includes an upper surface 11 and a lower surface 12. The upper surface 11 is provided with a first connector 3. The lower surface 12 is provided with a second connector 4. When the pillowcase 1 sleeves the pillow interior 2, and the first connector 3 is detachably connected to the second connector 4 via the opening 21 to enable the upper surface 11 and the lower surface 12 to clamp the pillow interior 2, the upper surface 11 and the lower surface 12 press the pillow interior 2 to form a neck brace supporting portion 5. By using the above structure, the traction pillow includes a pillowcase and an elastic pillow interior. The pillow interior has an opening. The opening penetrates from an upper side of the pillow interior to a lower side of the pillow interior. The pillowcase includes an upper surface and a lower surface. The upper surface is provided with a first connector. The lower surface is provided with a second connector. When the pillowcase sleeves the pillow interior, and the first connector is detachably connected to the second connector via the opening to enable the upper surface and the lower surface to clamp the pillow interior, the upper surface and the lower surface press the pillow interior to form a neck brace supporting portion.

Compared with the neck brace supporting portion directly formed in an existing ordinary pillow on the market, the neck brace supporting portion formed by pressing the pillow interior by the upper surface and the lower surface of the pillowcase is more full and has stronger cervical traction feeling, so that the traction pillow can provide a higher elastic reset supporting force, is not prone to collapse, and can provide a strong support to the neck, relax the muscles around the neck, improve the blood circulation, relieve the symptoms of neck pain and numbness, and improve the user experience.

In this embodiment, the first connector 3 is arranged on an inner side of the upper surface 11, and the second connector 4 is arranged on an inner side of the lower surface 12. The first connector 3 includes a first connection portion 31 and a first connection surface 32. One side of the first connection surface 32 is connected to the inner side of the upper surface 11. The first connection portion 31 is connected to the other side of the first connection surface 32. The second connector 4 includes a second connection portion 41 and a second connection surface 42. One side of the second connection surface 42 is connected to the inner side of the lower surface 12. The second connection portion 41 is connected to the other side of the second connection surface 42. The first connection portion 31 is detachably connected with the second connection portion 41. Specifically, the first connection portion is a first connection buckle, and the second connection portion is a second connection buckle. The first connection buckle and the second connection buckle are detachably connected. By using the above structure, the upper surface and the first connection surface cover the first connection buckle, and the lower surface and the second connection surface cover the second connection buckle, so as to hide the first connection buckle and the second connection buckle. The traction pillow looks flatter and more beautiful, and direct contact between a user and the first connection buckle as well as the second connection buckle during use can also be effectively prevented, so as to prevent the user from having a foreign body sensation and a discomfort feeling in the cervical vertebra, and to make it easier for the user to accept the traction pillow. Further, the first connection surface is connected to the inner side of the upper surface in a suturing manner, and the second connection surface is connected to the inner side of the lower surface in a suturing manner.

In this embodiment, when the first connector 3 is connected to the second connector 4 via the opening 21 to enable the upper surface 11 and the lower surface 12 to clamp the pillow interior 2, a first gap 7 is reserved between the upper surface 11 and the opening 21. A second gap 8 is reserved between the lower surface 12 and the opening 21. The first gap 7, the opening 21, and the second gap 8 are communicated with each other to form a heat dissipation channel. By using the above structure, when a user uses the pillow, heat can be dissipated through the heat dissipation channel, so as to prevent the heat from being concentrated on the pillow and make a more comfortable sleep environment for the user, to improve the sleep quality of the user.

In this embodiment, the opening 21 is formed in the middle of the pillow interior 2. When the first connector 3 is connected to the second connector 4 via the opening 21 to enable the upper surface 11 and the lower surface 12 to clamp the pillow interior 2, the upper surface 11 and the lower surface 12 press the pillow interior 2 to form the neck brace supporting portion 5 located in the middle and side wing portions 6 located on two sides. The upper surface 11 and the lower surface 12 press the pillow interior 2 to form a recessed neck brace supporting portion 5 located in the middle and raised side wing portions 6 located on the two sides. Specifically, the traction pillow further includes platforms 9 located on two sides of the pillow, and the platforms 9 are located below the side wing portions 6. Further, the side wing portions 6 are used for supporting the head, and the platforms 9 are used for supporting arms. By using the above structure, when the traction pillow is used, the recessed neck brace supporting portion formed by pressing the pillow interior can better abut against the cervical curve of a user, to provide a stable, strong, and full support for the cervical vertebra, relax the muscles around the neck, improve the blood circulation, relieve the symptoms of neck pain and numbness, and improve the user experience. Furthermore, the side wing portions formed by pressing the pillow interior can provide a stable, strong, and full support for the head, relax the muscles around the shoulders, improve the blood circulation, and relieve the symptoms of shoulder pain and numbness. Much further, during sleeping, a user can put the arms on the platforms no matter the user lies supine or prostrate, so that the platforms can support the arms to relieve the symptoms of arm pain and numbness.

In this embodiment, the pillow interior is a memory foam pillow interior or a latex pillow interior. The pillowcase 1 has a sleeving hole 13. The pillowcase 1 sleeves the pillow interior 2 via the sleeving hole 13. A zipper 131 is arranged at the sleeving hole 13. The zipper 131 is used for opening or closing the sleeving hole 13. By using the above structure, the memory foam pillow interior or the latex pillow interior has the characteristics of air permeability, hygroscopicity, and good elasticity. Thanks to its unique softness and high latex elasticity, the traction pillow can comply with the cervical curve. The full neck brace supporting portion formed by pressing the memory foam pillow interior or the latex pillow interior can support the cervical vertebra of a user more powerfully, and can also make the neck get better relax, to achieve an objective of better protecting the cervical vertebra. Due to the design according to the ergonomic principle, sleep is effectively prompted. For some cervical spondylosis patients, the traction pillow can achieve the objectives of prevention and treatment. Sometimes, the traction pillow is also helpful for some patients suffering from high blood pressure, snoring, asthma, and other diseases. Further, the user can also open or close the sleeving hole by using the zipper, so that it is convenient for the user to replace and clean the pillowcase.

As described above, one or more embodiments are provided in conjunction with the detailed description, The specific implementation of the present disclosure is not confirmed to be limited to that the description is similar to or similar to the method, the structure and the like of the present disclosure, or a plurality of technical deductions or substitutions are made on the premise of the conception of the present disclosure to be regarded as the protection of the present disclosure.

What is claimed is:

1. A traction pillow, comprising a pillowcase (1) and an elastic pillow interior (2), wherein the pillow interior (2) has an opening (21); the opening (21) penetrates from an upper side of the pillow interior (2) to a lower side of the pillow interior (2); the pillowcase (1) comprises an upper surface (11) and a lower surface (12); the upper surface (11) is provided with a first connector (3); the lower surface (12) is provided with a second connector (4); and when the pillowcase (1) sleeves the pillow interior (2), and the first connector (3) is detachably connected to the second connector (4) via the opening (21) to enable the upper surface (11) and the lower surface (12) to clamp the pillow interior (2), the upper surface (11) and the lower surface (12) press the pillow interior (2) to form a neck brace supporting portion (5);

wherein when the first connector (3) is connected to the second connector (4) via the opening (21) to enable the upper surface (11) and the lower surface (12) to clamp the pillow interior (2), a first gap (7) is reserved between the upper surface (11) and the opening (21); a second gap (8) is reserved between the lower surface (12) and the opening (21); and the first gap (7), the opening (21), and the second gap (8) are communicated with each other to form a heat dissipation channel.

2. The traction pillow according to claim 1, wherein the first connector (3) is arranged on an inner side of the upper surface (11), and the second connector (4) is arranged on an inner side of the lower surface (12).

3. The traction pillow according to claim 2, wherein the first connector (3) comprises a first connection portion (31) and a first connection surface (32); one side of the first connection surface (32) is connected to the inner side of the upper surface (11); the first connection portion (31) is connected to the other side of the first connection surface (32); the second connector (4) comprises a second connection portion (41) and a second connection surface (42); one side of the second connection surface (42) is connected to the inner side of the lower surface (12); the second connection portion (41) is connected to the other side of the second connection surface (42); and the first connection portion (31) is detachably connected with the second connection portion (41).

4. The traction pillow according to claim 1, wherein the opening (21) is formed in the middle of the pillow interior (2); when the first connector (3) is connected to the second connector (4) via the opening (21) to enable the upper surface (11) and the lower surface (12) to clamp the pillow interior (2), the upper surface (11) and the lower surface (12) press the pillow interior (2) to form the neck brace supporting portion (5) located in the middle and side wing portions (6) located on two sides.

5. The traction pillow according to claim 4, wherein the upper surface (11) and the lower surface (12) press the pillow interior (2) to form the neck brace supporting portion (5) located in the middle and raised side wing portions (6) located on the two sides, and the neck brace supporting portion (5) is a recessed neck brace supporting portion.

6. The traction pillow according to claim 5, further comprising platforms (9) located on two sides of the pillow, wherein the platforms (9) are located below the side wing portions (6).

7. The traction pillow according to claim 6, wherein the side wing portions (6) are used for supporting the head, and the platforms (9) are used for supporting arms.

8. The traction pillow according to claim 1, wherein the pillow interior is a memory foam pillow interior or a latex pillow interior.

9. The traction pillow according to claim 1, wherein the pillowcase (1) has a sleeving hole (13); the pillowcase (1) sleeves the pillow interior (2) via the sleeving hole (13); a zipper (131) is arranged at the sleeving hole (13); and the zipper (131) is used for opening or closing the sleeving hole (13).

10. A traction pillow, comprising a pillowcase (1) and an elastic pillow interior (2), wherein the pillow interior (2) has an opening (21); the opening (21) penetrates from an upper side of the pillow interior (2) to a lower side of the pillow interior (2); the pillowcase (1) comprises an upper surface (11) and a lower surface (12); the upper surface (11) is provided with a first connector (3); the lower surface (12) is provided with a second connector (4); and when the pillowcase (1) sleeves the pillow interior (2), and the first connector (3) is detachably connected to the second connector (4) via the opening (21) to enable the upper surface (11) and the lower surface (12) to clamp the pillow interior (2), the upper surface (11) has a concave portion to serve as a neck brace supporting portion (5);

when the first connector (3) is connected to the second connector (4) via the opening (21) to enable the upper surface (11) and the lower surface (12) to clamp the pillow interior (2), a first gap (7) is reserved between the upper surface (11) and the opening (21); a second gap (8) is reserved between the lower surface (12) and the opening (21); and the first gap (7), the opening (21), and the second gap (8) are communicated with each other to form a heat dissipation channel.

11. The traction pillow according to claim 10, wherein the first connector (3) is arranged on an inner side of the upper surface (11), and the second connector (4) is arranged on an inner side of the lower surface (12).

12. The traction pillow according to claim 11, wherein the first connector (3) comprises a first connection portion (31) and a first connection surface (32); one side of the first connection surface (32) is connected to the inner side of the upper surface (11); the first connection portion (31) is connected to the other side of the first connection surface (32); the second connector (4) comprises a second connection portion (41) and a second connection surface (42); one side of the second connection surface (42) is connected to the inner side of the lower surface (12); the second connection portion (41) is connected to the other side of the second connection surface (42); and the first connection portion (31) is detachably connected with the second connection portion (41).

13. The traction pillow according to claim 10, wherein the opening (21) is formed in the middle of the pillow interior (2); when the first connector (3) is connected to the second connector (4) via the opening (21) to enable the upper surface (11) and the lower surface (12) to clamp the pillow interior (2), the upper surface (11) and the lower surface (12) press the pillow interior (2) to form the neck brace supporting portion (5) located in the middle and side wing portions (6) located on two sides.

14. The traction pillow according to claim 13, wherein twherein the upper surface (11) and the lower surface (12) press the pillow interior (2) to form the neck brace supporting portion (5) located in the middle and raised side wing portions (6) located on the two sides, and the neck brace supporting portion (5) is a recessed neck brace supporting portion.

15. The traction pillow according to claim 14, further comprising platforms (9) located on two sides of the pillow, wherein the platforms (9) are located below the side wing portions (6).

16. The traction pillow according to claim 15, wherein the side wing portions (6) are used for supporting the head, and the platforms (9) are used for supporting arms.

17. The traction pillow according to claim 10, wherein the pillow interior is a memory foam pillow interior or a latex pillow interior.

18. The traction pillow according to claim 10, wherein the pillowcase (1) has a sleeving hole (13); the pillowcase (1) sleeves the pillow interior (2) via the sleeving hole (13); a zipper (131) is arranged at the sleeving hole (13); and the zipper (131) is used for opening or closing the sleeving hole (13).

* * * * *